US007801460B2

(12) United States Patent
Masubuchi

(10) Patent No.: US 7,801,460 B2
(45) Date of Patent: Sep. 21, 2010

(54) IMAGE-FORMING APPARATUS, IMAGE-FORMING APPARATUS BODY, REPLACEMENT PART, AND METHOD OF HANDLING STORAGE MEDIUM MOUNTED ON REPLACEMENT PART OF IMAGE-FORMING APPARATUS

(75) Inventor: Yukio Masubuchi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 807 days.

(21) Appl. No.: 11/687,021

(22) Filed: Mar. 16, 2007

(65) Prior Publication Data

US 2008/0012961 A1 Jan. 17, 2008

(30) Foreign Application Priority Data

Jul. 14, 2006 (JP) ..... 2006-194209

(51) Int. Cl.
*G03G 15/00* (2006.01)

(52) U.S. Cl. ..... 399/83; 399/113; 399/227; 348/231.7

(58) Field of Classification Search ..... 399/83, 399/113, 119, 227–229; 348/231.7
See application file for complete search history.

(56) References Cited

U.S. PATENT DOCUMENTS 6,173,119 B1 * 1/2001 Manico et al. ..... 396/6
6,827,279 B2 * 12/2004 Teraura ..... 235/492

FOREIGN PATENT DOCUMENTS

| | | |
|---|---|---|
| JP | 10221938 | 8/1998 |
| JP | 2004109188 | 4/2004 |
| JP | 2004126017 | 4/2004 |

* cited by examiner

*Primary Examiner*—David M Gray
*Assistant Examiner*—Barnabas T Fekete
(74) *Attorney, Agent, or Firm*—Gauthier & Connors LLP

(57) ABSTRACT

An image-forming apparatus has: an apparatus body; and a replacement part that is detachably mounted in the apparatus body, wherein the replacement part includes: a replacement part body; and a storage medium that is separably mounted on the replacement part body, and wherein the apparatus body includes a separation mechanism that separates the storage medium from the replacement part body when the replacement part body is mounted in the apparatus body.

6 Claims, 11 Drawing Sheets

IMAGE-FORMING APPARATUS, IMAGE-FORMING APPARATUS BODY, REPLACEMENT PART, AND METHOD OF HANDLING STORAGE MEDIUM MOUNTED ON REPLACEMENT PART OF IMAGE-FORMING APPARATUS

CROSS-REFERENCE TO RELATED APPLICATIONS

This application is based on and claims priority under 35 USC 119 from Japanese Patent Application No. 2006-194209 filed on Jul. 14, 2006.

BACKGROUND

1. Technical Field

The present invention generally relates to an image-forming apparatus, an image-forming apparatus body, a replacement part, and a method of handling a storage medium mounted on the replacement part of the image-forming apparatus.

2. Related Art

A known image-forming apparatus includes an apparatus body, and a replacement part that is detachably mounted in the above described apparatus body, wherein the apparatus body exchanges data with a storage medium mounted on the replacement part.

SUMMARY

According to one aspect of the present invention, there is provided an image-forming apparatus having: an apparatus body; and a replacement part that is detachably mounted in the apparatus body, wherein the replacement part includes: a replacement part body; and a storage medium that is separably mounted on the replacement part body, and wherein the apparatus body includes a separation mechanism that separates the storage medium from the replacement part body when the replacement part body is mounted in the apparatus body.

BRIEF DESCRIPTION OF THE DRAWINGS

Exemplary embodiments of the present invention will be described in detail by reference to the following figures, wherein.

DETAILED DESCRIPTION

Hereinafter an exemplary embodiment of the present invention will be described by reference to the figures.

[Basic Configuration and Operation]

Figure 1:
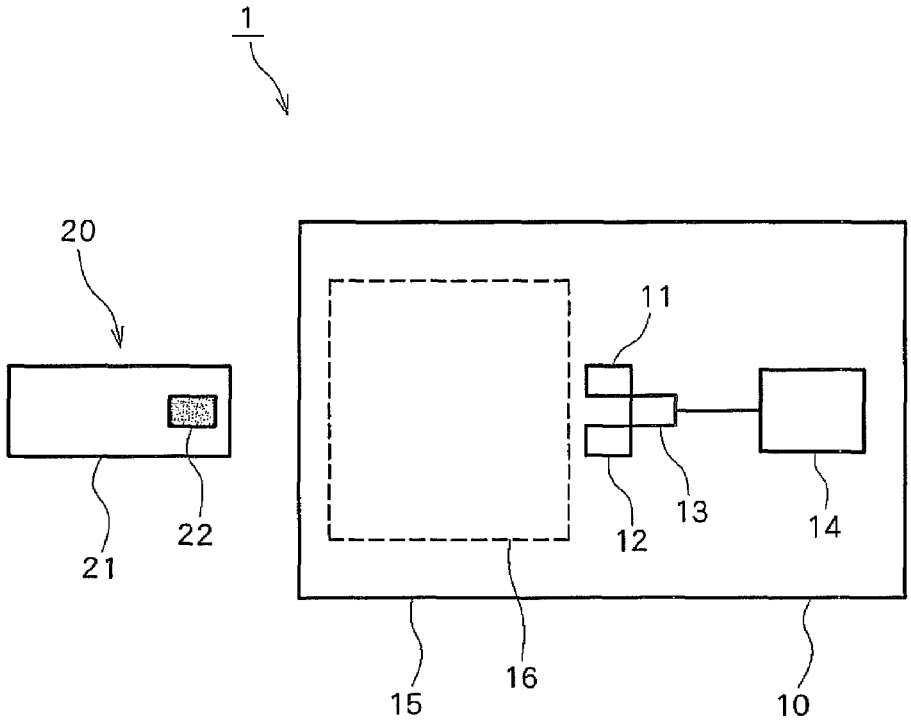
FIG. 1 is a block diagram showing the basic configuration of an image-forming apparatus according to an exemplary embodiment.
Figure 2:
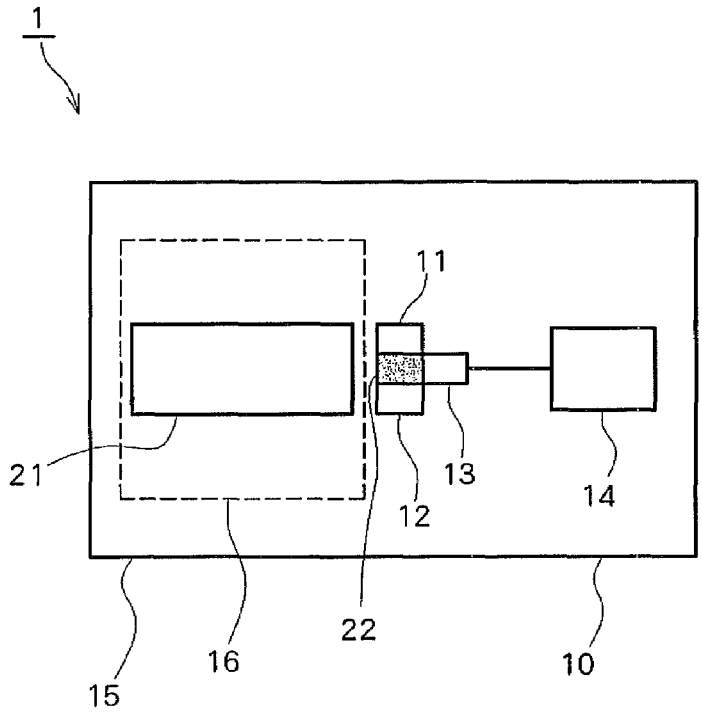
FIG. 2 is a block diagram showing the basic configuration of the image-forming apparatus according to the exemplary embodiment.

FIGS. 1 and 2 are block diagrams showing the basic configuration of an image-forming apparatus 1 according to this exemplary embodiment. Hereinafter, by reference to FIGS. 1 and 2, the basic configuration and operation of the image-forming apparatus 1 according to this exemplary embodiment will be described.

The image-forming apparatus 1 is an apparatus that forms an image with respect to a recording medium such as a paper sheet by an appropriate printing method such as a xerography method or an inkjet method. For example, the image-forming apparatus 1 is a copying machine, a printer, a digital multifunction product, or the like.

As shown in FIG. 1, the image-forming apparatus 1 has an image-forming apparatus body (hereinafter referred to as "apparatus body") 10 and a replacement part 20 that is detachably mounted in this apparatus body 10. It should be noted that FIG. 1 shows a state where the replacement part 20 is not mounted in the apparatus body 10, and FIG. 2 shows a state where the replacement part 20 is mounted in the apparatus body 10.

The apparatus body 10 is a substantially fixed portion in relation to the replacement part 20. The replacement part 20 is generally a consumable supply that is appropriately replaced if it has been consumed, and may be, for example, a toner cartridge, a photoreceptor unit, a developing unit, a transfer unit, a fixing unit, an ink cartridge, or the like.

The replacement part 20 includes a replacement part body 21 as its main portion and a storage medium 22 that is separably mounted on the above-described replacement part body 21. The storage medium 22 retains specific information on quality of the replacement part body 21 and the like. For example, the storage medium 22 may be a readable and writable nonvolatile storage medium. The storage medium 22 may be accessed by means of a wired method or a wireless method. For example, the storage medium 22 may be a wired memory tag including a contact electrode, or a wireless memory tag including an antenna.

The apparatus body 10 includes a separation mechanism 11, a mounting mechanism 12, a connection section 13, and a control section 14.

The separation mechanism 11 is a mechanism that separates the storage medium 22 from the above-described replacement part body 21 when the replacement part body 21 is mounted in the apparatus body 10. It should be noted that the separation mechanism 11 may separate the storage medium 22 during the course of the mounting operation, or may separate the storage medium 22 after completion of the mounting operation.

The mounting mechanism 12 is a mechanism that mounts the storage medium 22 separated by the above-described separation mechanism 11, on the above-described replacement part body 21 when the replacement part body 21 is detached from the apparatus body 10.

Although the separation mechanism 11 and the mounting mechanism 12 may be configured in a physically separated manner, they are preferably configured in a physically integrated manner. The separation mechanism 11 and the mounting mechanism 12 may be any mechanism that separates and mounts the storage medium 22, and can be realized with an appropriate configuration. For example, the separation mechanism 11 and the mounting mechanism 12 may mechanically detach and attach the storage medium 22, may detach and attach the same by means of magnetic force, or may detach and attach the same by means of air suction force.

The connection section 13 is an interface for exchanging data with the storage medium 22 separated by the separation mechanism 11. For example, the connection section 13 is a connector physically connected to a wired storage medium 22, a reader/writer device (also referred to as "coupler") including an antenna that wirelessly communicates with a wireless storage medium 22, or the like.

The control section 14 controls the entire image-forming apparatus 1, and exchanges the data with the storage medium 22 via the connection section 13.

In the above-described configuration, in the exemplary embodiment, the replacement part body 21 mounted in the apparatus body 10 moves, while the storage medium 22 separated by the separation mechanism 11 is held in a fixed manner with respect to the connection section 13. For example, the apparatus body 10 includes a substratum 15, and a movable unit 16 which is provided movably with respect to the above-described substratum 15 and to which the replacement part body 21 is attached and detached. The separation mechanism 11 separates the storage medium 22 from the above-described replacement part body 21 and holds the above-described storage medium 22 on the side of the substratum 15, when the replacement part body 21 is mounted in the movable unit 16. In addition, the mounting mechanism 12 mounts the storage medium 22 separated by the separation mechanism 11, on the above-described replacement part body 21, when the replacement part body 21 is detached from the movable unit 16. The connection section 13 is provided on the side of the substratum 15.

Next, the basic operation of the image-forming apparatus 1 having the above-described configuration will be described.

When a user mounts the replacement part body 21 in the apparatus body 10, the separation mechanism 11 separates the storage medium 22 from the above-described replacement part body 21. As shown in FIG. 2, the separated storage medium 22 is held at a position connectable to the connection section 13 in the apparatus body 10.

After the replacement part 20 is mounted, the apparatus body 10 cooperates with the replacement part body 21 to form the image. At this point, the control section 14 reads data related to the replacement part body 21 (usage history data, manufacturing variability correction data, and the like) from the storage medium 22, and controls an image-forming operation on the basis of the above-described data, or writes the data related to the replacement part body 21 (the usage history data and the like) in the storage medium 22.

When the user detaches the replacement part body 21 from the apparatus body 10, the mounting mechanism 12 mounts the above-described separated storage medium 22 on the replacement part body 21.

In this way, in this exemplary embodiment, the storage medium 22 is detached from the replacement part body 21 when the replacement part 20 is mounted, and the storage medium 22 is returned to the replacement part body 21 when the replacement part 20 is detached.

[Specific Example of Image-Forming Apparatus]

Hereinafter a rotary multicolor image-forming apparatus 2 will be shown as a more specific example of the image-forming apparatus according to this exemplary embodiment.

(Simple Overview of Configuration and Operation)

Figure 3:
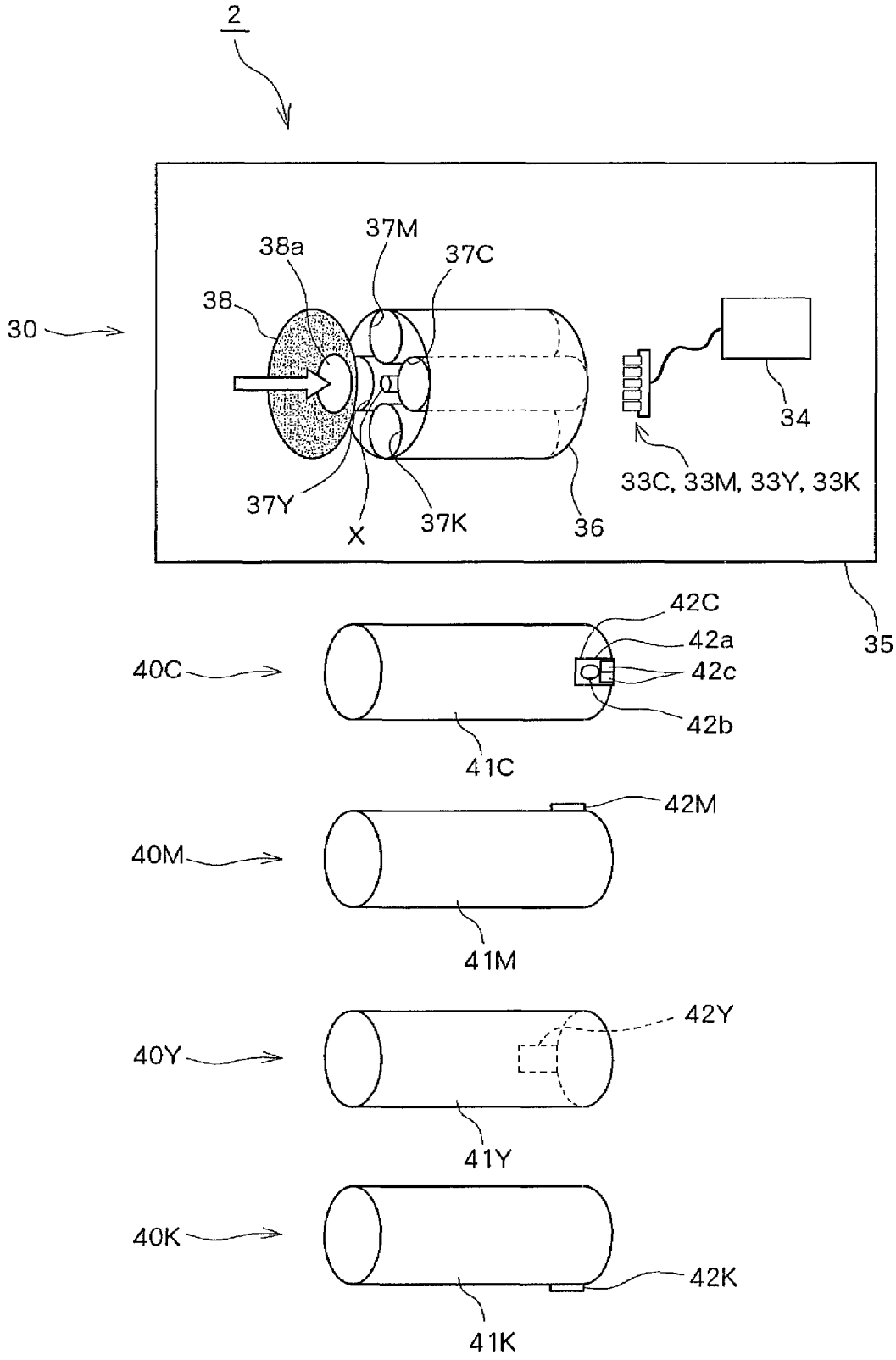
FIG. 3 is a schematic diagram showing the configuration of a multicolor image-forming apparatus according to a specific example.
Figure 4:
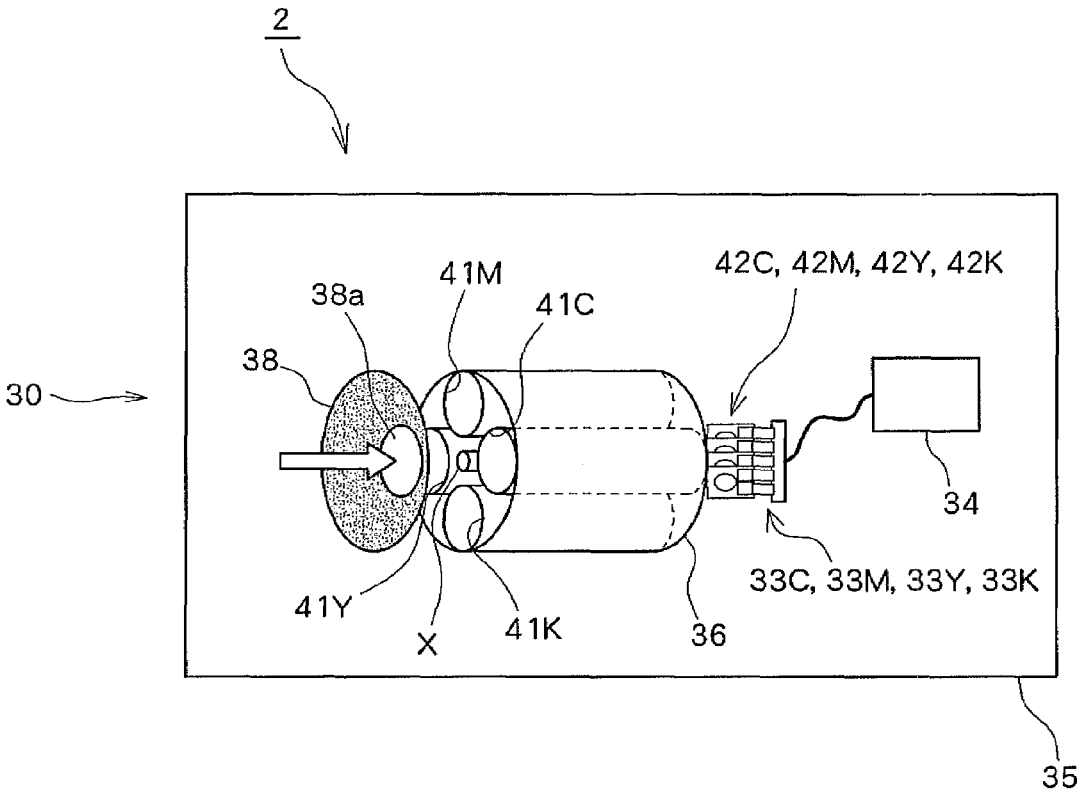
FIG. 4 is a schematic diagram showing the configuration of the multicolor image-forming apparatus according to the specific example.

FIGS. 3 and 4 are schematic diagrams showing the configuration of the multicolor image-forming apparatus 2 according to this specific example. Hereinafter, by reference to FIGS. 3 and 4, the configuration and operation of the multicolor image forming apparatus 2 according to this specific example will be schematically described.

As shown in FIG. 3, the multicolor image-forming apparatus 2 has an apparatus body 30, and toner cartridges of four colors 40C, 40M, 40Y, and 40K detachably mounted in this apparatus body 30. The toner cartridges 40C, 40M, 40Y, and 40K are cartridges for housing toners of cyan (C), magenta (M), yellow (Y), and black (K), respectively. In the following description, the toner cartridges 40C, 40M, 40Y, and 40K are collectively referred to as "toner cartridge 40" as appropriate. In other words, a letter suffixed to a reference numeral for representing a color is omitted as appropriate. Other reference numerals described below are referred to in a similar manner. It should be noted that FIG. 3 shows a state where the toner cartridge 40 is not mounted in the apparatus body 30, and FIG. 4 shows a state where the toner cartridge 40 is mounted in the apparatus body 30.

The toner cartridges 40C, 40M, 40Y, and 40K include toner cartridge bodies 41C, 41M, 41Y and 41K for housing the toners, and substrate units 42C, 42M, 42Y, and 42K separably mounted on the toner cartridge body 41, respectively.

The substrate unit 42 has a substrate 42*a* on which a memory IC (Integrated Circuit) 42*b* and two electrodes 42*c* for accessing the above-described memory IC 42*b* are provided. The memory IC 42*b* is a nonvolatile storage device that retains specific information on quality of the toner cartridge body 41 and the like, such as EEPROM (Electronically Erasable and Programmable Read Only Memory), for example.

In this specific example, the toner cartridge body 41 has an approximately cylindrical shape, and the substrate unit 42 has an approximately rectangular planar shape. The toner cartridge body 41 is, for example, 100 mm in diameter and 300 to 500 mm in length, and the substrate unit 42 is, for example, 20 mm by 30 mm.

The apparatus body 30 includes a substratum 35, and a rotary developing unit 36 provided rotatably around a rotation axis X with respect to the above-described substratum 35. The substratum 35 is a substantially fixed portion in relation to the rotary developing unit 36. The rotary developing unit 36 is a unit in which the toner cartridge body 41 of each color is attached and detached around the rotation axis X and which rotates integrally with the toner cartridge body 41 around the rotation axis X.

The rotary developing unit 36 has toner cartridge housing sections 37C, 37M, 37Y, and 37K for the respective colors, which are formed around the rotation axis X. In this specific example, the rotary developing unit 36 is a revolver-type developing unit, in which the toner cartridge body 41 of each color is attached and detached with respect to the toner cartridge housing section 37 of the corresponding color, at a replacement position common to each color. Specifically, on the substratum 35, an insertion opening definition member 38 that defines a toner cartridge insertion opening 38*a* is provided in a fixed manner. The toner cartridge insertion opening 38*a* is provided so that it faces the four toner cartridge housing sections 37 one at a time in sequence, according to the rotation of the rotary developing unit 36. For example, at a rotation position where the toner cartridge insertion opening 38*a* faces the toner cartridge housing section 37C, the toner cartridge body 41C becomes detachable with respect to the toner cartridge housing section 37C via the toner cartridge insertion opening 38*a*. With respect to the other colors (M, Y and K), the detachable color is similarly switched in sequence, according to the rotation of the rotary developing unit 36.

In the substratum 35, four detachment and attachment mechanisms 31C, 31M, 31Y, and 31K for the respective colors (not shown in FIGS. 3 and 4), four contact-type connectors 33C, 33M, 33Y, and 33K for the respective colors, and a control unit 34 connected to the contact-type connectors 33 via a cable are provided.

The detachment and attachment mechanism 31 is a mechanism functioning as a separation mechanism and a mounting mechanism. In other words, when the toner cartridge body 41 of the corresponding color is mounted in the rotary developing unit 36, the detachment and attachment mechanism 31 separates the substrate unit 42 from the above-described toner cartridge body 41 and holds the above-described substrate unit 42 on the side of the substratum 35. In addition, when the toner cartridge body 41 of the corresponding color is detached from the rotary developing unit 36, the detachment and attachment mechanism 31 mounts the above-described separated substrate unit 42 on the above-described toner cartridge body 41. It should be noted that a specific arrangement and configuration of the detachment and attachment mechanism 31 will be described below in detail.

The contact-type connector 33 is a wired communication interface for exchanging data with the substrate unit 42 of the corresponding color separated by the detachment and attachment mechanism 31. Specifically, the contact-type connector 33 has two contact points contacting the respective electrodes 42*c* of the substrate unit 42.

The control unit 34 controls the entire multicolor image-forming apparatus 2, and exchanges data with the memory IC 42*b* of the substrate unit 42 via the contact-type connector 33. The control unit 34 is, for example, a circuit substrate mounted with a CPU (Central Processing Unit), ROM (Read Only Memory), RAM (Random Access Memory), an ASIC (Application Specific Integrated Circuit), and the like.

Next, the operation of the multicolor image-forming apparatus 2 having the above-described configuration will be schematically described.

The toner cartridge body 41 mounted with the substrate unit 42 is inserted by the user into one opening of the rotary developing unit 36 having openings like those of a revolver in the apparatus body 30; that is, into one toner cartridge housing section 37 opening via the toner cartridge insertion opening 38*a*. When this toner cartridge body 41 is inserted, the substrate unit 42 is separated from the toner cartridge body 41 by the detachment and attachment mechanism 31. When this substrate unit 42 is separated, the electrodes 42*c* of the substrate unit 42 are inserted in the contact-type connector 33. Thereby the control unit 34 can read or write the memory IC 42*b* via wired communication.

After the toner cartridge 40 is mounted, the apparatus body 30 cooperates with the toner cartridge body 41 to form the image. At this point, the control unit 34 reads or writes the data with respect to the memory IC 42*b*.

If the toner runs out or the like, the toner cartridge body 41 is extracted by the user from one opening of the rotary developing unit 36 having the openings like those of a revolver in the apparatus body 30; that is, from one toner cartridge housing section 37 opening via the toner cartridge insertion opening 38*a*. When this toner cartridge body 41 is extracted, the substrate unit 42 held by the detachment and attachment mechanism 31 is returned to its original position on the toner cartridge body 41 by the detachment and attachment mechanism 31. In other words, when the toner cartridge body 41 is extracted from the rotary developing unit 36, the substrate unit 42 is also extracted together with the above-described toner cartridge body 41.

(Configuration and Operation Related to Image Forming)

Figure 5:
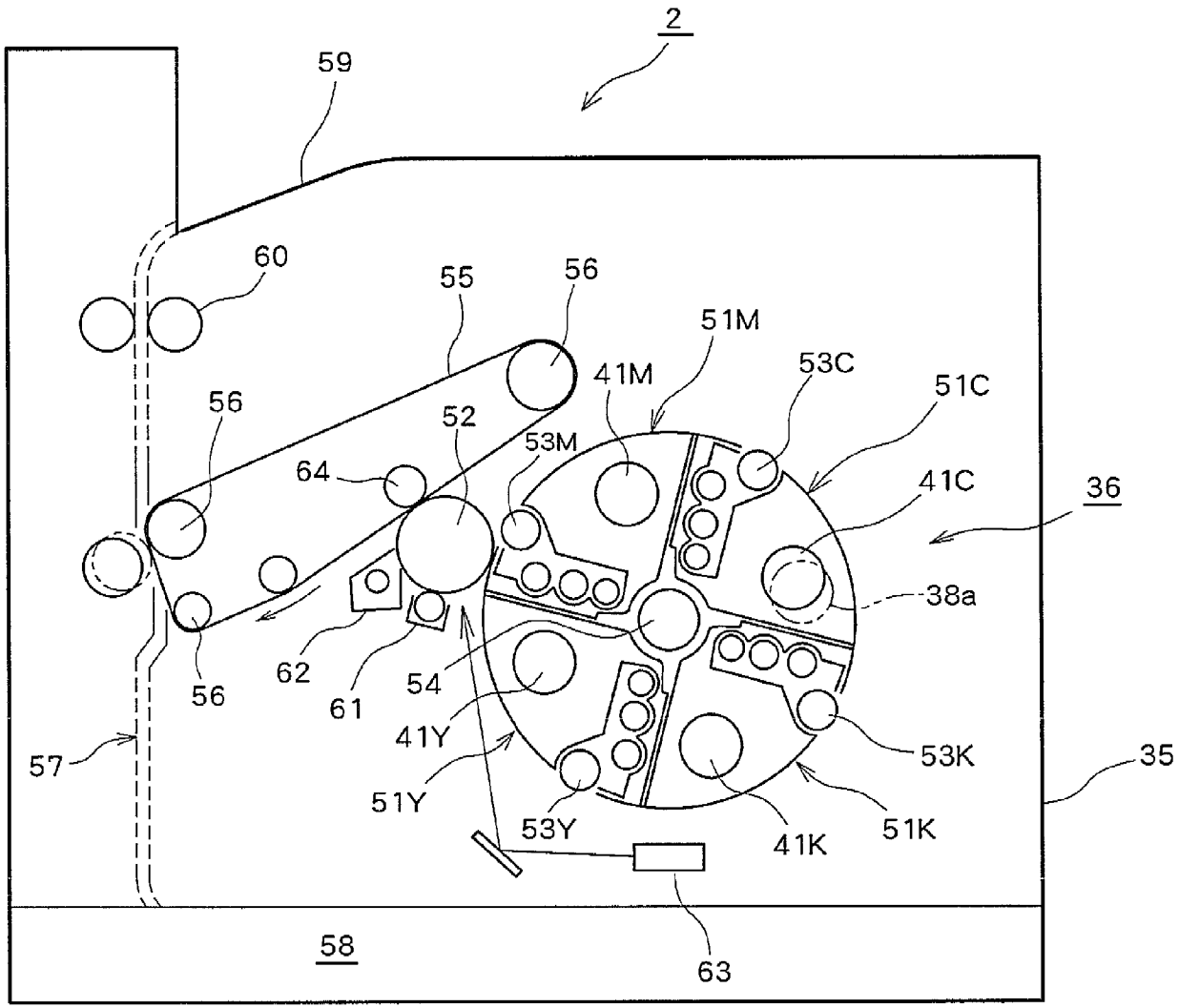
FIG. 5 shows the detailed configuration of the multicolor image-forming apparatus according to the specific example.

FIG. 5 shows a detailed configuration of the multicolor image-forming apparatus 2 according to this specific example. Hereinafter, by reference to FIG. 5, a configuration and an operation related to the image forming by the multicolor image-forming apparatus 2 will be described in more detail. It should be noted that the configuration and the operation related to the detachment and attachment of the substrate unit 42 will not be described here.

The rotary developing unit 36 has developing sections of four colors 51C, 51M, 51Y and 51K. The toner cartridge housing section 37 (not shown in FIG. 5) corresponding to each color of the developing section 51 is provided in each developing section 51, and the toner cartridge body 41 is mounted in this toner cartridge housing section 37.

At the front side of the rotary developing unit 36, the insertion opening definition member 38 (not shown in FIG. 5) that configures a frame of the substratum 35 is arranged. The insertion opening definition member 38 is, for example, a steel plate. This insertion opening definition member 38 is provided with the toner cartridge insertion opening 38*a* for replacing the toner cartridge. The position of this toner cartridge insertion opening 38*a* is shown by a dashed line in FIG. 5.

A photoreceptor drum 52 is arranged adjacent to the rotary developing unit 36. Each developing section 51 is provided with a developing roller 53 that sends the toner sent from the toner cartridge body 41 to the photoreceptor drum 52.

The rotary developing unit 36 is rotatably driven by a driving motor (not shown) via a developing machine axis 54. This rotation driving positions the developing roller 53 of a desired color to face the photoreceptor drum 52. A transfer belt 55 contacts the photoreceptor drum 52. The transfer belt 55 is wound around multiple rollers 56, and is driven to revolve by one driving roller among these rollers. A toner image on the photoreceptor drum 52 is transferred on the transfer belt 55, and this toner image is carried to a paper-conveying path 57 according to the revolving of the belt. Through the paper-conveying path 57, the paper sheet is conveyed from a paper feed tray 58 to a paper ejection tray 59, and the toner image on the belt is transferred on the paper sheet at a position facing the transfer belt 55. The paper sheet on which the toner image has been transferred proceeds on the paper-conveying path 57, and is heated and pressurized by a fixing roller 60 to fix the image, and then ejected to the paper ejection tray 59.

Next, forming of the toner image will be described. Around the photoreceptor drum 52, in addition to the above-described rotary developing unit 36 and the transfer belt 55, a charging section 61 that charges a surface of the photoreceptor drum 52, and a cleaner 62 that recovers the toner left without being transferred on the photoreceptor drum are arranged. The photoreceptor drum 52 rotates in the counterclockwise direction in FIG. 5, thereby sending the drum surface uniformly charged by the charging section 61 toward the developing section 51 of any color in the rotary developing unit 36. Before reaching the developing section 51, the drum surface is scanned by a laser beam emitted from an exposure section 63, an unnecessary portion of charge is eliminated, and a latent image is formed on the drum surface. The exposure section 63 is controlled on the basis of image data created by an external device or image data read by a scanner, and the latent image corresponding to this image data is formed.

When the drum surface reaches the developing section 51, the toner is attracted to the drum surface from the developing roller 53 by the charge on the surface, and the latent image is developed as the toner image. According to the rotation of the drum, the toner image on the photoreceptor drum 52 is further carried to the position facing the transfer belt 55. A transfer roller 64 is arranged on the reverse side of the transfer belt 55. A voltage is applied to this transfer roller 64 so that the toner on the drum 52 is attracted to the transfer belt 55. Thereby the image on the photoreceptor drum 52 is transferred on the transfer belt 55 (primary transfer). After the toner image has been transferred, the surface of the photoreceptor drum 52 is cleaned by the cleaner 62, and reaches the charging section 61 again to be charged again. Then, this sequence is repeated to form the toner image corresponding to one paper sheet on the transfer belt.

For forming a multicolor image, after the toner image of one color is formed on the transfer belt 55, the rotary developing unit 36 rotates, the developing roller 53 of another color faces the photoreceptor drum 52, and the toner image of the color is formed in an overlapping manner on the toner image of the previous color. When the toner images of necessary colors have been formed on the transfer belt 55, the paper sheet is conveyed and the toner image is transferred on the paper sheet (secondary transfer).

(Arrangement of Detachment and Attachment Mechanism)

Figure 6:
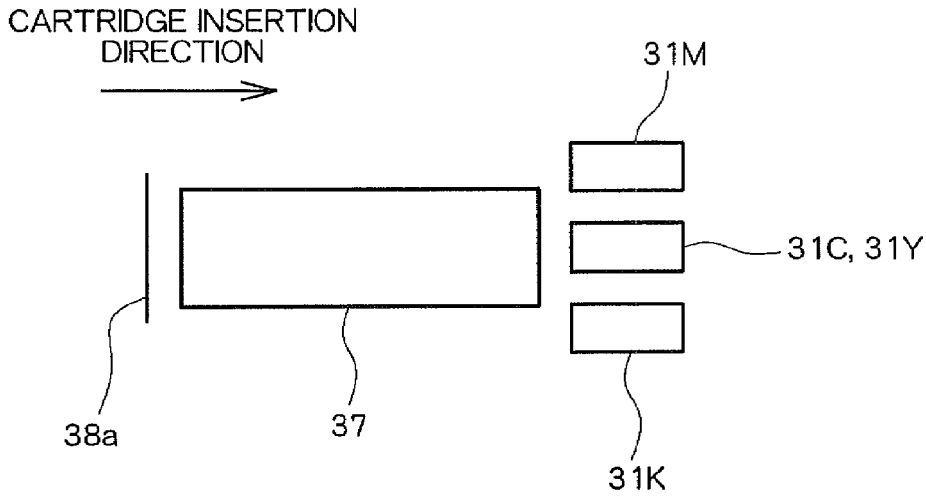
FIG. 6 schematically shows an arrangement example of a detachment and attachment mechanism.
Figure 7:
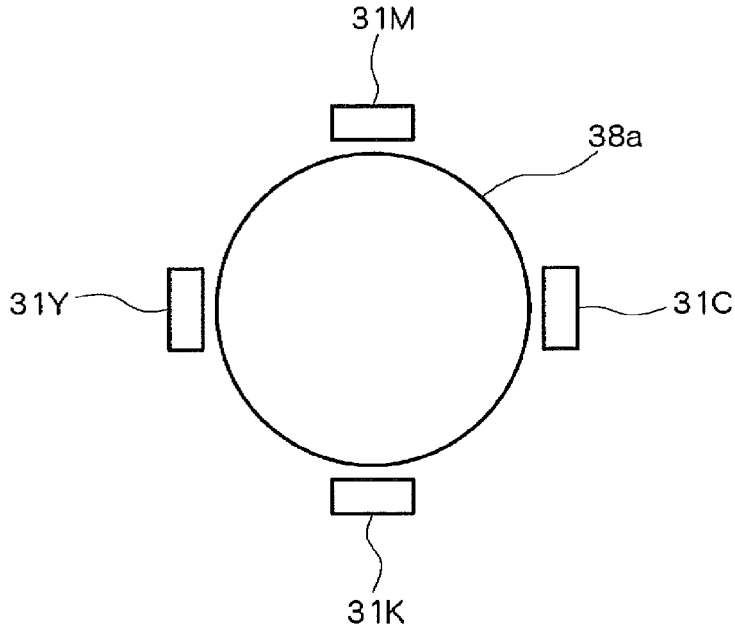
FIG. 7 schematically shows the arrangement example of the detachment and attachment mechanism.

FIGS. 6 and 7 schematically show an arrangement example of the detachment and attachment mechanism 31. FIG. 6 shows the apparatus body 30 in FIG. 3 viewed from the front side, vertically with respect to a direction of inserting the toner cartridge. FIG. 7 shows the apparatus body 30 in FIG. 3 viewed from the left side, parallel to the direction of inserting the toner cartridge. Hereinafter, by reference to FIGS. 6 and 7, the arrangement of the detachment and attachment mechanism 31 will be described.

As shown in FIGS. 6 and 7, the detachment and attachment mechanisms 31C, 31M, 31Y and 31K are provided at different positions for the respective colors.

As shown in FIG. 6, the detachment and attachment mechanism 31 is arranged in proximity to an end of an edge side in the direction of inserting the toner cartridge in the rotary developing unit 36.

As shown in FIG. 7, when viewed from the direction of inserting the toner cartridge, the detachment and attachment mechanisms 31C, 31M, 31Y, and 31K are arranged at 90-degree intervals around the toner cartridge insertion opening 38*a*.

Meanwhile, in the toner cartridge 40 of each color, as shown in FIG. 3, the substrate unit 42 is arranged at a position on the toner cartridge body 41 corresponding to a position of the detachment and attachment mechanism 31 of the above-described color.

Specifically, on the side of the apparatus body 30 (for example, the toner cartridge insertion opening 38*a* and the toner cartridge housing section 37), a guide member (for example, a guide rail or a guide groove) for guiding insertion or extraction of the toner cartridge body 41 is provided at a position in a circumferential direction common to each color. On the side of the toner cartridge body 41, a guided member (for example, a guided projection or a guided rail) that is guided by the guide member on the side of the apparatus body 30 is provided. In addition, on the toner cartridge body 41 of each color, the substrate unit 42 is arranged at a position corresponding to the detachment and attachment mechanism 31 corresponding to the above-described color, on the basis of the position of the guided member. In other words, on the basis of the position of the guided member, the position at which the substrate unit 42 is mounted is different for each color.

In the above-described configuration, the toner cartridge body 41 of each color is inserted in the toner cartridge housing section 37 with the guided member being guided by the guide member. Therefore, the toner cartridge body 41 of each color is inserted in the toner cartridge housing section 37 in a state where the guided member faces the direction common to each color. Thereby, the substrate unit 42 arranged at an appropriate position for each color on the basis of the position of the guided member is appropriately guided to the detachment and attachment mechanism 31 of the corresponding color.

(Substrate-Unit-Holding Structure of Toner Cartridge Body)

Figure 8:
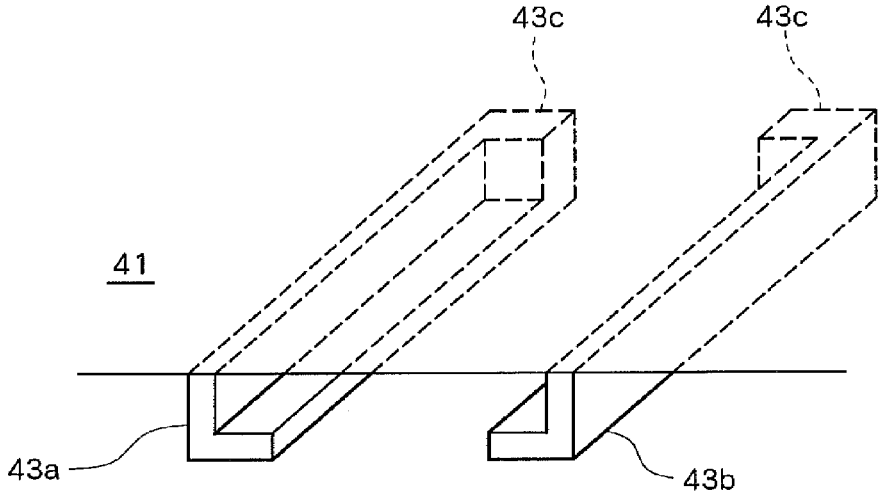
FIG. 8 shows a substrate-unit-holding structure of a toner cartridge body.
Figure 9:
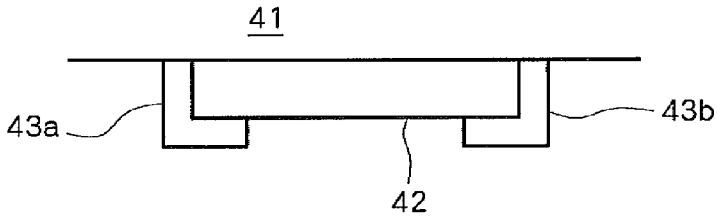
FIG. 9 shows the substrate-unit-holding structure of the toner cartridge body.
Figure 10:
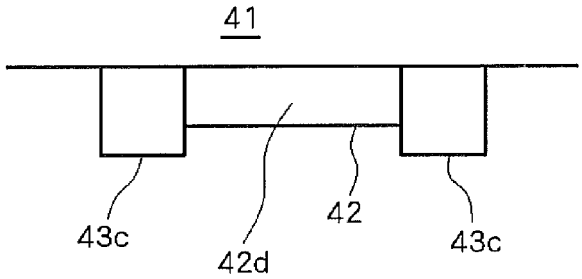
FIG. 10 shows the substrate-unit-holding structure of the toner cartridge body.

FIGS. 8 to 10 show a substrate-unit-holding structure 43 of the toner cartridge body 41. FIG. 8 is a perspective view of the substrate-unit-holding structure 43. FIG. 9 shows the substrate-unit-holding structure 43 as viewed from behind in a direction of mounting the substrate unit. FIG. 10 shows the substrate-unit-holding structure 43 as viewed from front in the direction of mounting the substrate unit. It should be noted that FIG. 8 dies not show the substrate unit 42.

As shown in FIGS. 8 to 10, the substrate-unit-holding structure 43 has a pair of rail members 43*a* and 43*b* for pinching and holding the substrate unit 42 from the two sides of the mounting direction. The rail members 43*a* and 43*b* are members having L-shaped cross-sections and are provided in an extended condition on the surface of the toner cartridge body 41, elongating in the direction of mounting the substrate unit. In addition, the substrate-unit-holding structure 43 has a striking member 43*c* that is struck at a face of an edge side in the mounting direction of the substrate unit 42. This striking member 43*c* is a member provided in an extended condition on the surface of the toner cartridge body 41. As shown in FIGS. 8 and 10, the striking member 43*c* is provided so that at least a click-contacting section 42*d* at the face of the edge side in the mounting direction of the substrate unit 42 is exposed.

(Configuration and Operation of Detachment and Attachment Mechanism)

FIGS. 11A to 11E are schematic diagrams for illustrating the configuration and an operation of the detachment and attachment mechanism 31. Hereinafter, by reference to FIGS. 11A to 11E (hereinafter collectively referred to as "FIG. 11" as appropriate), the configuration and the operation of the detachment and attachment mechanism 31 will be described. It should be noted that a direction of inserting the toner cartridge body 41 is referred to as "cartridge insertion direction" in the following description.

In FIG. 11, the detachment and attachment mechanism 31 has a push switch 71 having a self-locking mechanism. The push switch 71 is installed in a fixed manner in the substratum 35 (not shown in FIG. 11) with a switch face 71*a* being perpendicular to the cartridge insertion direction and movable in the cartridge insertion direction.

Figure 12A:
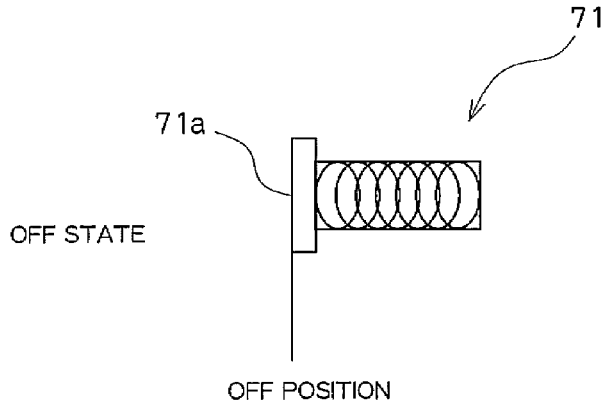
FIG. 12A is a schematic diagram for illustrating operation of a push switch.
Figure 12B:
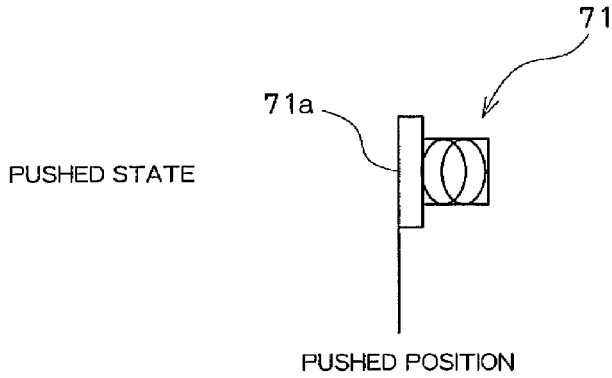
FIG. 12B is a schematic diagram for illustrating operation of the push switch.
Figure 12C:
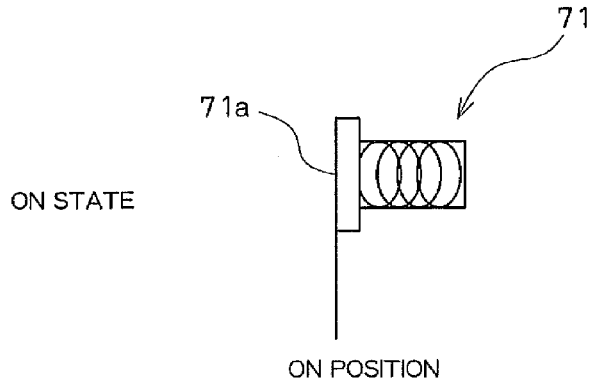
FIG. 12C is a schematic diagram for illustrating operation of the push switch.

Here, with reference to FIGS. 12A to 12C, an operation of the push switch 71 will be briefly described. In FIG. 12A, the push switch 71 is in an Off state, and the switch face 71*a* is located at an Off position. When the switch face 71*a* is pushed in this Off state, the push switch 71 assumes an On state shown in FIG. 12C through a state shown in FIG. 12B. In other words, after the switch face 71*a* is pushed to a Pushed position, the switch face 71*a* is slightly returned by spring force to be locked at an On position by the self-locking mechanism. This On position is located between the Off position and the Pushed position. When the switch face 71*a* is pushed in this On state, a lock of the self-locking mechanism is unlocked, and the push switch 71 assumes the Off state shown in FIG. 12A through the state shown in FIG. 12B. In other words, after the switch face 71*a* is pushed to the Pushed position, the switch face 71*a* is returned to the Off position by the spring force. In this way, the push switch 71 is a switch that is alternately switched on and off in a repeating manner each time it is pushed.

Again with reference to FIG. 11, the switch face 71*a* of the push switch 71 is connected to an end of a first coupling member 72 elongating in the cartridge insertion direction. The other end of the first coupling member 72 is connected to an end of a second coupling member 73 via an axis P1. The other end of the second coupling member 73 is connected to an end of a third coupling member 74 elongating in a reverse direction of the cartridge insertion direction via an axis P2. The other end of the third coupling member 74 is connected to an end of a click mechanism 75 via an axis P3. This click mechanism 75 is a stopper member having its other end for holding a click-mechanism-contacting section 42*d* of the substrate unit 42. An intermediate portion between the respective ends of the second coupling member 73 is pivotally supported with an axis P4 by the substratum 35. An intermediate portion between the two ends of the click mechanism 75 is pivotally supported with an axis P5 by the substratum 35.

Furthermore, the detachment and attachment mechanism 31 has a solenoid actuator (hereinafter referred to as "solenoid") 76 for pushing an edge face, in the cartridge insertion direction, of the toner cartridge body 41. The solenoid 76 is installed in a fixed manner in the substratum 35. The solenoid 76 includes a movable iron core 76*a* reciprocating along the cartridge insertion direction.

Hereinafter, the operation of the detachment and attachment mechanism 31 having the above-described configuration will be described.

First, the operation when the toner cartridge body 41 is mounted will be described. When the user inserts the toner cartridge body 41 in the rotary developing unit 36, it assumes a state shown in FIG. 11B through a state shown in FIG. 11A. In other words, the edge face in the cartridge insertion direction of the substrate unit 42 contacts the switch face 71*a* at the Off position. When the toner cartridge body 41 is further pushed in this state, it assumes a state shown in FIG. 11C. In other words, after the switch face 71*a* is pushed to the Pushed position by the substrate unit 42, the switch face 71*a* is locked at the On position. At this point, displacement of the switch face 71*a* from the Off position to the On position makes the click mechanism 75 stand up.

Figure 11A:
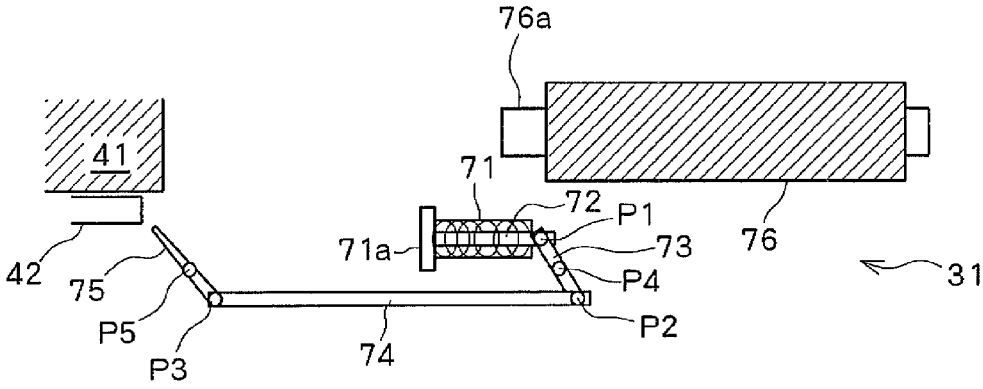
FIG. 11A is a schematic diagram for illustrating a configuration and an operation of the detachment and attachment mechanism.
Figure 11B:
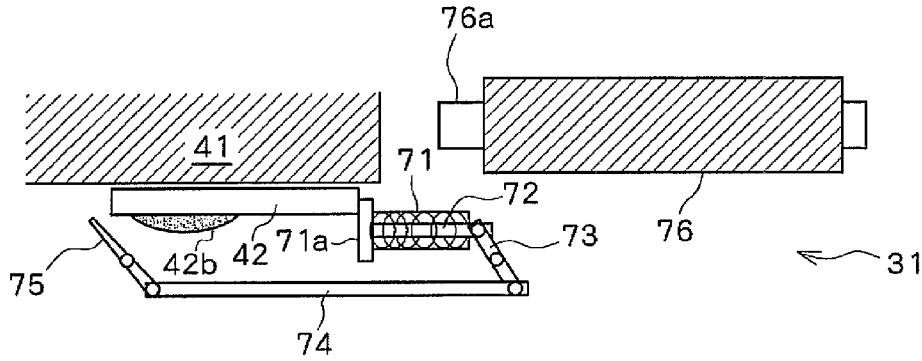
FIG. 11B is a schematic diagram for illustrating the configuration and the operation of the detachment and attachment mechanism.
Figure 11C:
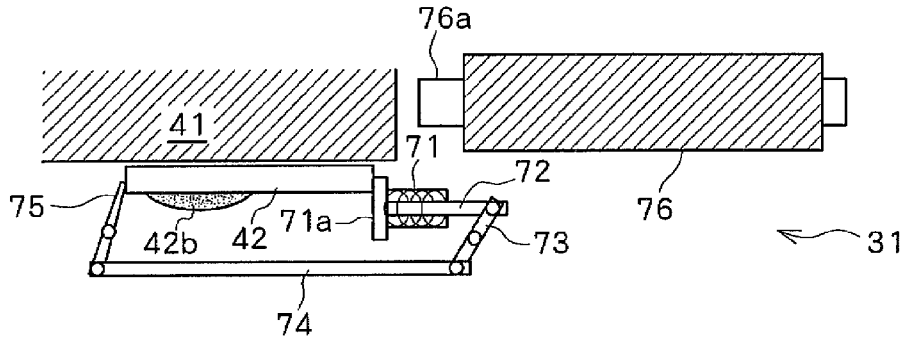
FIG. 11C is a schematic diagram for illustrating the configuration and the operation of the detachment and attachment mechanism.
Figure 11D:
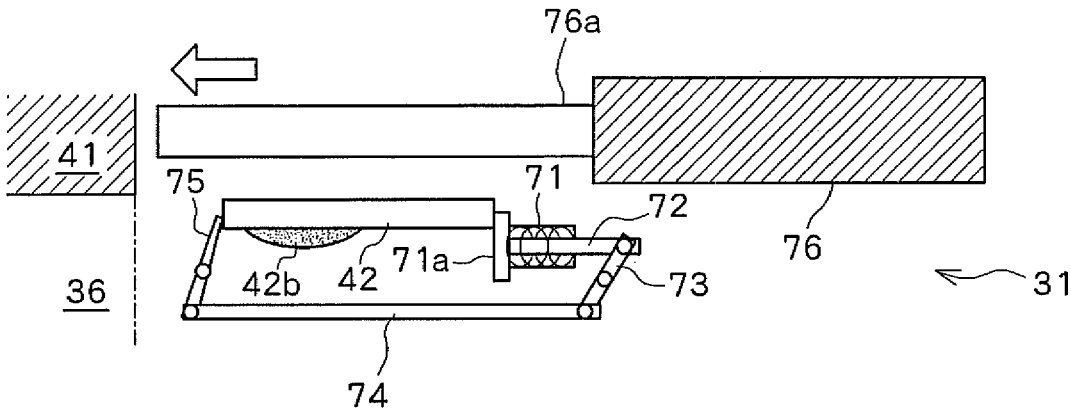
FIG. 11D is a schematic diagram for illustrating the configuration and the operation of the detachment and attachment mechanism.
Figure 11E:
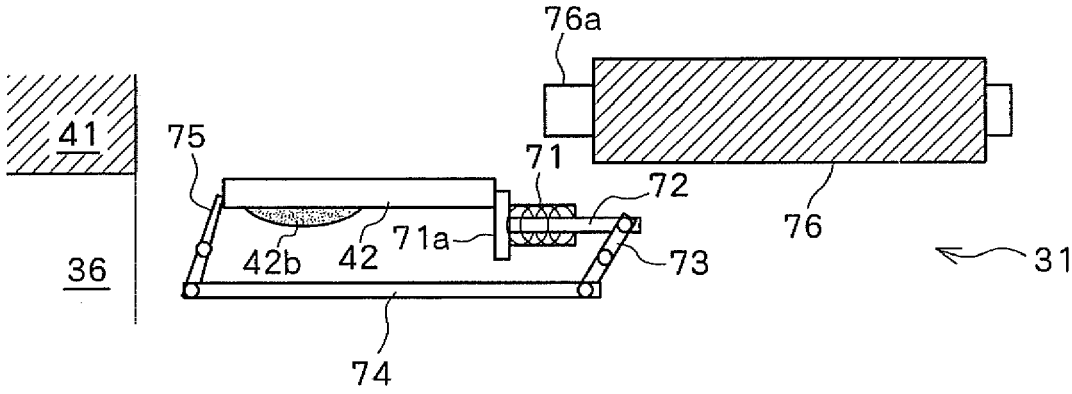
FIG. 11E is a schematic diagram for illustrating the configuration and the operation of the detachment and attachment mechanism.

When the control unit 34 senses by means of a sensor (not shown) that the state has transited to the state shown in FIG. 11C; that is, for example, when the control unit 34 senses that the push switch 71 has been turned on, the control unit 34 controls the solenoid 76 to project the movable iron core 76*a* toward the toner cartridge body 41. Thereby it assumes a state shown in FIG. 11D. In other words, the toner cartridge body 41 is pushed by the movable iron core 76*a* in the reverse direction of the cartridge insertion direction to be set in the rotary developing unit 36. At this point, the substrate unit 42 is held by the standing click mechanism 75, so that the substrate unit 42 is prevented from moving in the reverse direction of the cartridge insertion direction. Thereby, the substrate unit 42 separates from the toner cartridge body 41 to remain on the side of the substratum 35. Then, the movable iron core 76*a* is returned to its original position and assumes a state shown in FIG. 11E.

Next, the operation when the toner cartridge body 41 is extracted will be described. If the toner cartridge body 41 is extracted from the apparatus body 30 due to running out of the toner and the like, the user pushes the toner cartridge body 41 in the cartridge insertion direction. In the state shown in FIG. 11E, when the toner cartridge body 41 is pushed in the cartridge insertion direction, it assumes the state shown in FIG. 11C. In other words, movement of the toner cartridge body 41 in the cartridge insertion direction mounts the substrate unit 42 on the toner cartridge body 41. If the toner cartridge body 41 is further pushed in this state, it assumes the state shown in FIG. 11B. In other words, after the switch face 71*a* is pushed to the Pushed position by the substrate unit 42, the switch face 71*a* returns to the Off position. In addition, displacement of the switch face 71*a* from the On position to the Off position makes the click mechanism 75 fall down to unlock the standing state of the click mechanism 75. Then the user extracts the toner cartridge body 41 from the apparatus body 30. At this point, since the substrate unit 42 is not held by the click mechanism 75, the substrate unit 42 is in the state of being mounted on the toner cartridge body 41 and is extracted from the apparatus body 30.

(Variations)

Figure 13:
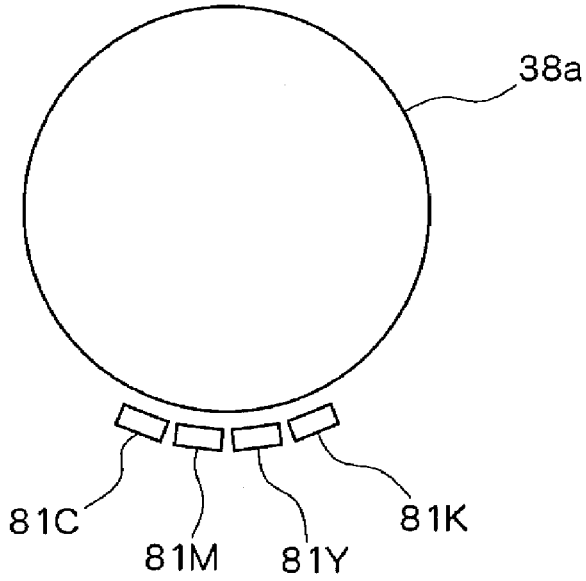
FIG. 13 shows a configuration in which multiple wireless tags are held in proximity to one another.

It should be noted that although the above-described specific example uses a wired storage medium, a wireless storage medium such as a wireless tag (noncontact IC tag) may be used. In this case, instead of the contact-type connector 33, the reader/writer device (also referred to as "coupler") including the antenna is installed. Moreover, in the case of the wireless method, separated multiple wireless tags may be held in a manner such that they are accessible by the same antenna. For example, as shown in FIG. 13, multiple wireless tags 81 can be accessed through one antenna in a configuration in which the multiple wireless tags 81 are held in proximity to one another.

Figure 14:
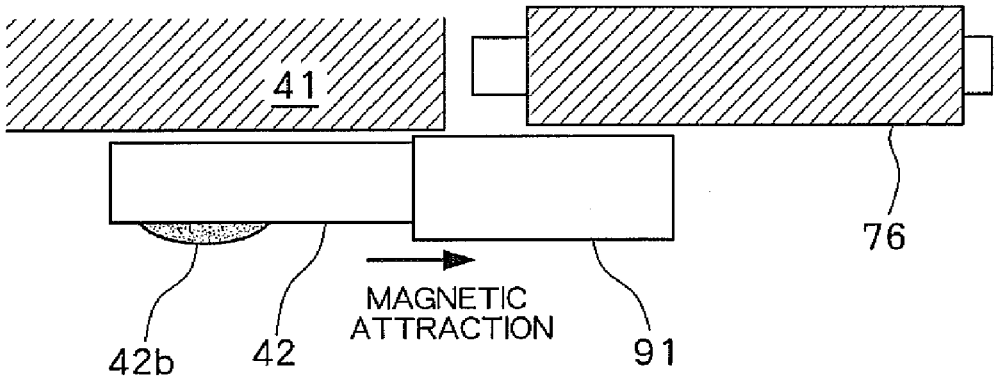
FIG. 14 shows a configuration in which a substrate unit is detached and attached by means of an electromagnet.
Figure 15:
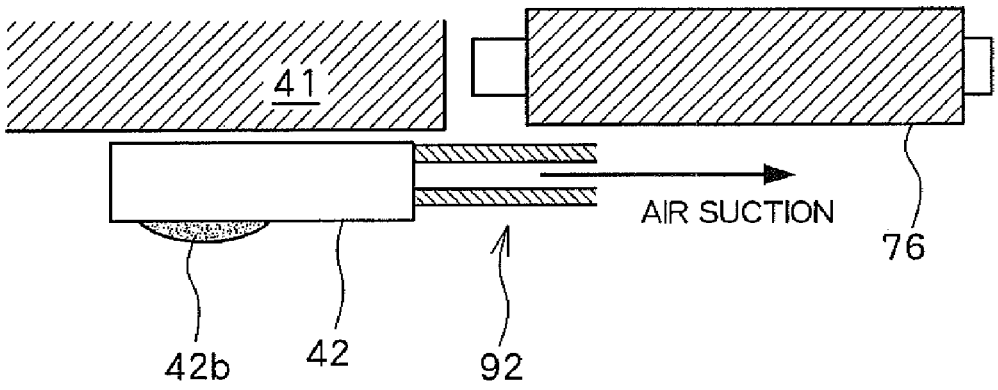
FIG. 15 shows a configuration in which the substrate unit is detached and attached by means of air pressure.

In addition, although the push switch 71 having the self-locking mechanism is used for detaching and attaching the substrate unit 42 in the above described specific example, the substrate unit 42 may be detached and attached by other methods. For example, as shown in FIG. 14, the substrate unit 42 may be detached and attached by means of an electromagnet. In FIG. 14, when the substrate unit 42 is separated, instead of being held by the click mechanism 75, the substrate unit 42 is attracted by an electromagnet 91 and prevented from moving in the reverse direction of the cartridge insertion direction. When the toner cartridge body 41 is extracted from the apparatus body 30, the electromagnet 91 is in an Off state. Alternatively, as shown in FIG. 15, the substrate unit 42 may be detached and attached by means of air pressure. In FIG. 15, when the substrate unit 42 is separated, instead of being held by the click mechanism 75, the substrate unit 42 is adsorbed by an air suction device 92 and prevented from moving in the reverse direction of the cartridge insertion direction. When the toner cartridge body 41 is extracted from the apparatus body 30, the air suction device 92 is in an Off state.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with various modifications as are suited to the particular use contemplated. It is intended that the scope of the invention be defined by the following claims and their equivalents.

What is claimed is:

1. An image-forming apparatus comprising:

an apparatus body; and toner cartridges of multiple colors that are detachably mounted in the apparatus body, wherein each of the toner cartridges comprises:

a toner cartridge body; and a storage medium that is separably mounted on the toner cartridge body, wherein the apparatus body comprises:

a substratum;

a rotary developing unit provided rotatably around a rotation axis with respect to the substratum, in which a toner cartridge housing section of each color is formed around the rotation axis, and the toner cartridge body of each color is attached and detached with respect to the toner cartridge housing section of the corresponding color, at a replacement position common to each color; and a separation mechanism provided at a different position for each color in the substratum, which separates the storage medium from the toner cartridge body and holds the storage medium when the toner cartridge body of the corresponding color is mounted in the rotary developing unit, and wherein in the toner cartridge of each color, the storage medium is arranged at a position on the toner cartridge body corresponding to a position of the separation mechanism of the color.

2. The image-forming apparatus according to claim 1, wherein the apparatus body comprises a mounting mechanism provided for each color in the substratum, which mounts the separated storage medium on the toner cartridge body when the toner cartridge body of the corresponding color is detached from the rotary developing unit.

3. The image-forming apparatus according to claim 1, wherein the each storage medium is accessed by a wireless method and held in a manner accessible by a common antenna.

4. The image-forming apparatus according to claim 2, wherein each storage medium is accessed by a wireless method and held in a manner accessible by a common antenna.

5. An image-forming apparatus comprising:

an apparatus body; and a replacement part that is detachably mounted in the apparatus body, wherein the replacement part comprises:

a replacement part body; and a storage medium that is separably mounted on the replacement part body, wherein the apparatus body comprises a separation mechanism that separates the storage medium from the replacement part body when the replacement part body is mounted in the apparatus body, wherein the apparatus body comprises a mounting mechanism that mounts the separated storage medium on the replacement part body when the replacement part body is detached from the apparatus body, and wherein the separation mechanism and the mounting mechanism separate and mount the storage medium by means of magnetic force.

6. An image-forming apparatus comprising:

an apparatus body; and a replacement part that is detachably mounted in the apparatus body, wherein the replacement part comprises:

a replacement part body; and a storage medium that is separably mounted on the replacement part body, wherein the apparatus body comprises a separation mechanism that separates the storage medium from the replacement part body when the replacement part body is mounted in the apparatus body, wherein the apparatus body comprises a mounting mechanism that mounts the separated storage medium on the replacement part body when the replacement part body is detached from the apparatus body, and wherein the separation mechanism and the mounting mechanism separate and mount the storage medium by means of air suction force.

* * * * *